United States Patent [19]

Bernhard et al.

[11] Patent Number: 4,973,446

[45] Date of Patent: Nov. 27, 1990

[54] SILVER ALLOY COMPOSITIONS

[75] Inventors: Melvin Bernhard, Williamsville; James T. Sivertsen, Lockport, both of N.Y.

[73] Assignee: United Precious Metal Refining Co., Inc., Alden, N.Y.

[21] Appl. No.: 534,673

[22] Filed: Jun. 7, 1990

[51] Int. Cl.[5] ..... C22C 5/08

[52] U.S. Cl. ..... 420/504

[58] Field of Search ..... 420/504; 148/430, 431

[56] References Cited

FOREIGN PATENT DOCUMENTS 2303863 10/1976 France ..... 420/504
12658 1/1977 Japan ..... 420/504
23660 2/1977 Japan ..... 420/504

*Primary Examiner*—Melvyn J. Andrews
*Assistant Examiner*—Ralph D. Flatter
*Attorney, Agent, or Firm*—Sommer, Oliverio & Sommer

[57] ABSTRACT

An improved sterling silver alloy composition, exhibiting the desirable properties of reduced fire scale, reduced porosity and reduced grain size, consists essentially of the following parts by weight: about 92.5% silver, about 0.5% copper, about 4.25% zinc, about 0.02% indium, about 0.48% tin, about 1.25% of a boron-copper alloy containing about 2% boron and about 98% copper, and about 1% of a silicon-copper alloy containing about 10% silicon and about 90% copper.

3 Claims, No Drawings

SILVER ALLOY COMPOSITIONS

TECHNICAL FIELD

This invention relates generally to improved silver alloy compositions, and, more particularly, to an improved sterling silver alloy composition which exhibits the desirable properties of substantially-reduced formation of fire scale when the alloy is heated, reduced porosity and reduced grain size.

BACKGROUND ART

Many silver alloy compositions are known. Some of these are used for jewelry and flatware, while others are used in brazing compositions and as electrical conductors.

Among these various silver-containing alloys, sterling silver must contain at least 92.5% pure fine silver. The balance of this alloy may be some other metal, but typically includes a substantial percentage of copper. The presence of copper tends to increase the hardness of the resulting alloy.

Sterling silver is typically sold in the form of pellet-like shot. Hence, the user may readily pour out a desired quantity of such shot, melt it, and then cast it into the specific form desired. Investment casting is in widespread use for this purpose. This technique contemplates the formation of a mold into which the molten sterling silver alloy is poured. The material from which the mold is formed, typically contains calcium sulfate.

Silver has a known affinity for oxygen, which affinity increases with temperature. When exposed to air, molten silver will absorb about twenty-two times its volume of oxygen. Like silver, copper also has a great affinity for oxygen, typically forming copper oxide. This may be of the cupric or cuprous variety, or both. Hence, unless air is excluded during the casting process, the cast article may be porous and characterized by the presence of internal voids. Thus, in melting sterling silver and other silver-copper alloys, care must be taken to prevent oxidation.

Copper oxide, also known as fire scale, is typically a darkened portion which blemishes the cast article. Such fire scale is not limited to the surface of the cast article, as in the case of conventional tarnishes, but may penetrate the article to some depth. In some cases, such fire scale may not be removed by buffing and polishing. Moreover, the opportunity for the creation of fire scale exists when the alloy is initially formed as shot, when such shot is melted and recast to form the desired article, and subsequently if the cast article is thereafter annealed. In each of these cases, the alloy is heated, and, given the opportunity, may form fire scale.

As previously noted, the fire scale is more than a surface tarnish. Rather, it is a blemish which may permeate the cast article for some depth, and, in some cases, may not be removed by polishing. To the extent that it exists, the blemish caused by fire scale may lead to the rejection of as-cast parts. Moreover, such rejected parts may have to be re-refined into the elemental metals, and realloyed.

Accordingly, it would be generally desirable to provide an improved silver alloy which substantially reduces the formation of fire scale, which exhibits reduced porosity when recast, and which has a reduced grain size.

DISCLOSURE OF THE INVENTION

The present invention provides an improved silver alloy composition which exhibits the desirable properties of reduced fire scale, reduced porosity and reduced grain size.

The improved composition broadly consists essentially of the following parts by weight: about 89–93.5% silver, about 0.1–2% silcon, about 0.001–2% boron, about 0.5–5% zinc, about 0.5–6% copper, about 0.25–2% tin, and about 0.01–1.25% indium. The percentage of silver may be varied depending upon the quality of the alloy to be produced. The above ranges encompass both coin silver (i.e., containing at least 90% silver) and sterling silver (i.e., containing at least 92.5% silver).

One specific, and preferred, sterling silver alloy composition consists essentially of: about 92.5% silver, about 0.5% copper, about 4.25% zinc, about 0.02% indium, about 0.48% tin, about 1.25% of a boron-copper alloy containing about 2% boron and about 98% copper, and about 1% of a silicon-copper alloy containing about 10% silicon and about 90% copper. This particular composition would translate to a sterling silver alloy consisting essentially of: about 92.5% silver, about 2.625% copper, about 4.25% zinc, about 0.02% indium, about 0.48% tin, about 0.025% boron, and about 0.1% silicon. The above composition exhibits the desirable properties of reduced fire scale, both when originally alloyed and when subsequently recast, of reduced porosity, and of reduced grain size.

Accordingly, the general object of this invention is to provide an improved silver alloy composition.

Another object is to provide an improved silver alloy composition which shows a substantially-reduced tendency to form fire scale when heated.

Another object is to provide an improved sterling silver alloy composition which, by virtue of its reduced propensity to form fire scale, reduces the number of rejected parts when such alloy is subsequently recast.

These and other objects and advantages will become apparent from the foregoing and ongoing written specification, and the appended claims.

MODE(S) OF CARRYING OUT THE INVENTION

As noted above, the present invention provides an improved silver alloy composition. The improved composition is deemed to have particular use as both coin silver and sterling silver. However, these particular compositions are only illustrative. Hence, the invention should not be limited to compositions containing the minimal amounts of silver necessary to qualify for such grades. The invention broadly provides an improved alloy, which is particularly suited for use in investment casting procedures, which alloy exhibits the desirable properties of substantially reducing the formation of fire scale on the recast product, of greatly reduced porosity, as well as a reduction in grain size.

Coin silver, by definition, must contain at least 90% fine silver, with the balance being other metals, typically copper. Sterling silver, on the other hand, must contain at least 92.5% fine silver. Here again, silver is typically alloyed with copper because the alloyed material is harder than either of its constituents. Metals other than, or in addition to, copper may also be used in such alloy. Silver-copper alloys may oxidize to form a black- or red-colored blemish commonly known as "fire scale". Upon information and belief, fire scale is copper oxide. The cupric variety will produce a blackened blemish, whereas the cuprous variety will form a reddish blemish. In either case, this blemish is not limited to the surface of the article, as in the case of superficial tarnish (typically silver sulfide), but may penetrate the article more deeply. In some cases, the penetration is such that the defect or blemish cannot be removed by buffing and polishing.

The invention broadly provides an improved silver alloy composition, which consists essentially of the following parts by weight: about 89–93.5% pure fine silver, about 0.01–2% silicon, about 0.001–2% boron, about 0.5–5% zinc, about 0.5–6% copper, about 0.25–2% tin, and about 0.01–1.25% indium. In the foregoing composition, silicon acts as a deoxidant, which reduces the porosity of the recast alloy, and has a slight hardening effect. Boron is added to reduce the surface tension of the molten alloy, and to allow it to blend homogeneously. Zinc is added to reduce the melting point of the alloy, to add whiteness, to act as a copper substitute, as a deoxidant, and to improve fluidity of the alloy. Copper is added as a conventional hardening agent for silver, as well as the main carrying agent for the other materials. Tin is added to provide tarnish resistance, and for its hardening effect. Indium is added as a grain refining agent, and to improve the wetability of the alloy. Silver must, of course, be present in the necessary minimal percentage to qualify as either coin silver or sterling silver, as appropriate.

These metals, when alloyed in the ranges indicated, have been found to produce castings free of normal fire scale, with the additional advantages of greatly-reduced porosity rates and a reduced grain size.

In one specific composition, which qualifies a sterling silver, an alloy was produced to have: about 92.5% silver, about 0.5% copper, about 4.25% zinc, about 0.02% indium, about 0.48% tin, about 1.25% of a boron-copper alloy containing about 2% boron and about 98% copper, and about 1% of a silicon-copper alloy containing about 10% silicon and about 90% copper. Fine silver was weighed and placed in a crucible for melting. Zinc was weighed, and placed in the crucible. The crucible was then heated to melt the silver and zinc. The boron-copper alloy, tin, indium and silicon-copper alloy were then added to the melt as a pre-prepared blend, under a protective cover of natural gas to prevent unnecessary oxidation. When the mixture was molten, it was stirred and poured through a tundish into water, which solidified and shaped the granules in the form of shot. Quantities of such shot were then provided to recasters for testing. The shot was measured, remelted and poured into investment castings to produce desired articles. In all known cases, the recast article wash shown to be substantially free of fire scale, to have considerably reduced porosity, and to have a finer grain structure than conventional sterling silver alloys. Labor time in finishing the cast article was reduced due to the elimination of the step previously needed to remove fire scale. Moreover, the rejection rate of the recast articles was substantially reduced over conventional silver-copper alloy compositions.

Therefore, while a preferred form of the improved silver-alloy compositions has been described, and certain modifications thereof discussed and suggested, persons skilled in this art will readily appreciate that various additional changes and modifications may be made without departing from the spirit of this invention, as defined and differentiated by the following claims:

What is claimed is:

1. A silver alloy composition, consisting essentially of the following parts by weight: about 89–93.5% silver, about 0.01–2% silicon, about 0.001–2% boron, about 0.5–5% zinc, about 0.5–6% copper, about 0.25–2% tin, and about 0.01–1.25% indium.

2. A sterling silver alloy composition exhibiting the desirable properties of reduced fire scale, reduced porosity and reduced grain size, consisting essentially of the following parts by weight: about 92.5% silver, about 0.5% copper, about 4.25% zinc, about 0.02% indium, about 0.48% tin, about 1.25% of a boron-copper alloy containing about 2% boron and about 98% copper, and about 1% of a silicon-copper alloy containing about 10% silicon and about 90% copper.

3. A sterling silver alloy composition exhibiting the desirable properties of reduced fire scale, reduced porosity and reduced grain size, consisting essentially of the following parts by weight: about 92.5% silver, about 2.625% copper, about 4.25% zinc, about 0.02% indium, about 0.48% tin, about 0.025% boron, and about 0.1% silicon.

* * * * *